United States Patent [19]

Ryan

[11] 4,453,349

[45] Jun. 12, 1984

[54] FLOOR AND ROOF DECK

[75] Inventor: Thomas G. Ryan, Bethel Park, Pa.

[73] Assignee: Cyclops Corporation, Pittsburgh, Pa.

[21] Appl. No.: 236,188

[22] Filed: Feb. 20, 1981

[51] Int. Cl.[3] ..... E04B 1/74; E04C 2/32

[52] U.S. Cl. ..... 52/28; 52/39; 52/220; 52/404; 52/630

[58] Field of Search ..... 52/220, 221, 630, 28, 52/39, 332, 336, 338, 337, 537; 174/48, 49, 68 C, 97, 101; 138/111, 115, 157, 162, 163

[56] References Cited

U.S. PATENT DOCUMENTS

| | | | |
|---|---|---|---|
| 1,182,783 | 5/1916 | Mitchell | 138/163 |
| 1,767,168 | 6/1930 | Burt | 52/406 |
| 2,090,483 | 8/1937 | Mendez | 52/336 |
| 3,226,907 | 1/1966 | Gregoire | 52/28 |
| 3,374,590 | 3/1968 | Kessler | 52/221 |
| 3,660,482 | 5/1972 | Elizalde | 52/537 |
| 3,793,793 | 2/1974 | Dobbins | 52/221 |
| 3,812,636 | 5/1974 | Albrecht et al. | 52/630 |
| 4,178,469 | 12/1979 | Fork | 174/48 |

FOREIGN PATENT DOCUMENTS

| | | | |
|---|---|---|---|
| 1,361,487 | 4/1964 | France | 52/220 |
| 2,384,915 | 11/1978 | France | 52/537 |

*Primary Examiner*—Henry E. Raduazo
*Attorney, Agent, or Firm*—William J. Ruano

[57] ABSTRACT

A structural deck especially suited for floors and roofs. It comprises an undulating metal structure having substantially horizontal bottom walls and top walls interconnected by downwardly and outwardly tapered, substantially flat side walls. Doved-tailed flanges are provided on the top portions of the side walls to interlock with concrete poured above. The inner surfaces of the dove-tailed flanges serve as supports for accessories, such as insulation, lighting fixtures and the like. The bottom portions of the side walls have outwardly extending doved-tailed flanges serving as supports for readily detachable closure caps having varying shapes, especially for aesthetic purposes.

11 Claims, 12 Drawing Figures

FLOOR AND ROOF DECK

The invention relates to a structure especially suitable as a floor or roof deck.

An outstanding disadvantage of presently used metallic floor and roof decks is that the concrete poured on top of the deck is not interlocked with the deck and tends to separate therefrom. In many applications, hanger tabs are required for suspending acoustical ceilings, piping, ductwork or light equipment. This has necessitated use of pre-punched integral tabs, piercing or non-piercing hanger tabs, installed prior to pouring of the slab to form a floor deck.

Another disadvantage of presently used composite cellular floor decks having sprayed-on fireproofing material with a conventional one piece cover plate, is that such fireproofing material loses bond to the large flat cover plate under fire conditions and sections fall completely away from the deck.

Another disadvantage of presently used cellular sections blended with fluted sections to form modules is that a large number of different modules are require for inventory purposes to meet various requirements, also substantial amounts of steel are required for completing the modules.

In the case of an acoustical composite floor and roof deck, as presently used, insulation clips or expanded foam plastic spacers are required. Also insulation batts are often required to be stuffed from the end of the deck.

An object of the present invention is to overcome all the above-named disadvantages of presently used floor and roof decks.

A more specific object of the invention is to provide excellent mechanical locking action to the poured adjoining concrete slabs in composite floor decks and to enable hanger clips to be installed readily at locations to suit the equipment being suspended and which can be installed after the slab is poured. In fact, they can be changed or added at some later date to suit relocation or addition of equipment.

Another object is to provide separate, readily detachable cover plates to form longitudinal cells, which cover plates, do not require welding and which provide a considerable savings in steel, also which can be nested and shipped in a relatively small space as compared to present requirements of non-nesting metal structures.

Still another object is to provide a floor and roof deck in which the dove-tailed side walls enable easy and quick attachment of accessories, such as insulation and lighting fixtures as well as to provide a wide variety of combinations of open and closed cells for various applications.

Other objects and advantages of the invention will become more apparent from a study of the following description taken with the accompanying drawings wherein.

Figure 1:
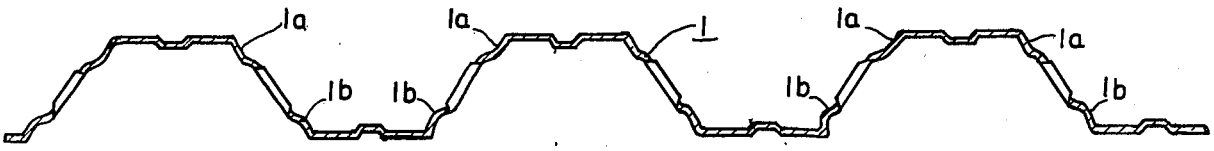
FIG. 1 is a side view showing a floor or roof deck structure initially having a 36" coverage, for example.
Figure 2:
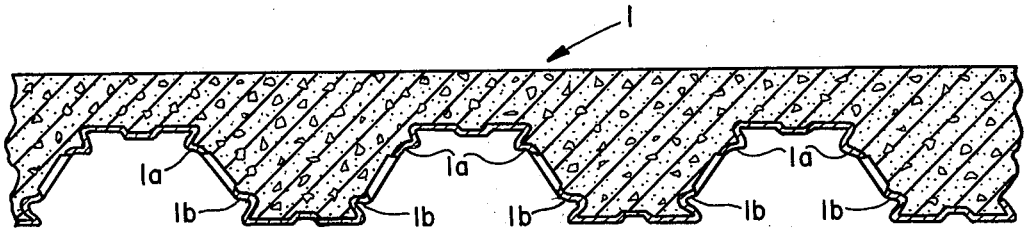
FIG. 2 is a side view of the same structure shown in FIG. 1 when doved-tailed flanges are provided which reduce said coverage to 30"

Referring more particularly to FIG. 1 showing an undulating metal structure having, for example, a 36" coverage, parts 1*a* and 1*b* have no interlocking effect with a poured concrete slab poured on top of the deck. (not shown) However, by forming upper dove-tailed flange 1*a* and lower dove-tailed flange 1*b* of the same thickness, as shown in FIG. 2, a very firm interlocking effect is provided with the concrete slab. The side walls are preferably at an angle of about 58° with respect to the plane of the bottom walls and are preferably ribbed, as shown, as well as the central top portion and bottom portion of the metal structure.

An important feature of the dove-tailed lower sections 1*b* is that they provide receptacles for receiving the end portions of longitudinally extending, readily detachable closures of any desired cross-section, typically of which are shown in FIGS. 3 to 6 inclusive, providing a versatile cellular deck.

Figure 3:
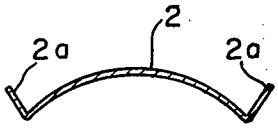
FIGS. 3,4, 5 and 6 show various cross-sectional designs of the detachable cap fitting into the lower dove-tailed flanges of FIG. 2.

For example, the longitudinally extending closure 2 of FIG. 3 has upwardly bent end portions 2*a* that are sprung together and snugly fitted inside the lower dove-tailed sections 1*b*. The surface of the closure 2 is flutted or of concave shape to provide an attractive appearance.

Figure 4:
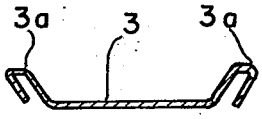

FIG. 4 shows a flat surface 3 with end reversely bent portions 3*a* which are detachably fitted in the dove-tailed flanges 1*b*.

Figure 5:
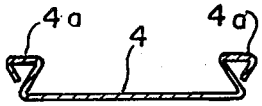

FIG. 5 shows a similar, readily detachable closure 4 having inverted triangular end portions 4*a* to spring into snugly fitted opposite dove-tailed sections 1*b*.

Figure 6:
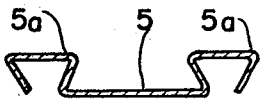

FIG. 6 shows a somewhat similar closure element 5 with end portions 5*a* which are extended in spaced relationship to the flat surface 5 in the same plane thereof.

The closures in FIGS. 3 to 6 inclusive may be embossed, perforated, slotted, painted, laminated or otherwise finished. The structure and/or caps may be of steel, aluminum, stainless steel, plastic or other suitable material depending upon the application.

Figure 7:
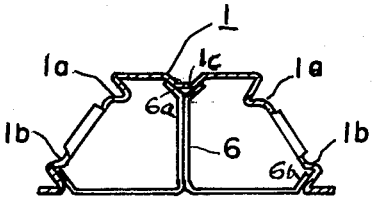
FIG. 7 shows a divider cap and support.

FIG. 7 shows a divider cap structure for dividing the cell in half. The divider portion 6*a* is laterally supported from the depression or rib in the top wall 1*c* while the horizontal portion 6*b* is supported by the dovetail portion 1*b* of the deck.

Figure 8:
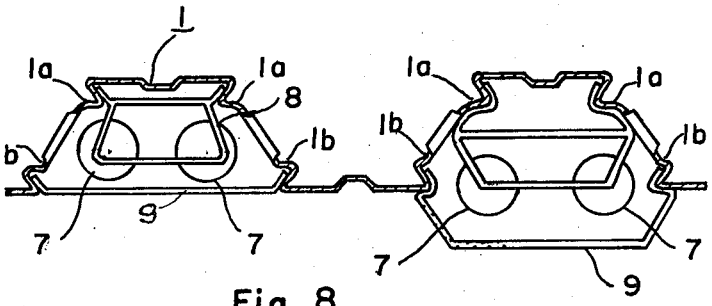
FIG. 8 shows two different modifications of clips for supporting light fixtures.

FIG. 8 shows raceways for lighting fixtures 7, the one shown on the left provided with spring mounted clips 8 terminating in upwardly and outwardly flared end portions which detachably fit into the upper dove-tailed flanges 1*a*. The assembly shown on the right is an alternate dropped assembly to bring the fixtures below the surface of the deck, in both events a clear translucent detachable cover 9, preferably of plastic material, is provided with end portions sprung and detachably fitted to the lower dove-tailed flanges 1*b*.

Figure 9:
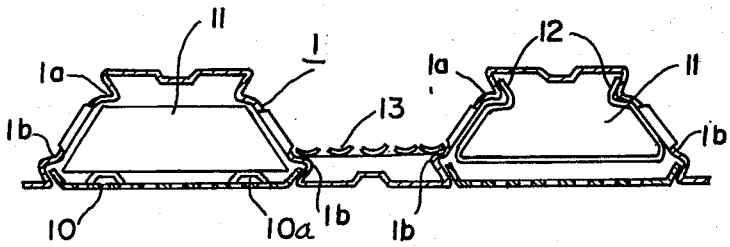
FIG. 9 shows two different modifications for supporting acoustical insulation batts.

FIG. 9 shows an acoustic cellular system having detachable covers or caps 10 which are perforated throughout and which are provided with spacer bosses 10*a* to provide a space between the cover 10 and insulation batt 11.

The assembly to the right shows a similar batt 11 which is supported by spring clips 12 snugly fitted in the upper dove-tailed sections 1*a*, eliminating the necessity of spacer bosses 10*a*. Numeral 13 shows an insulating concrete vent grid to enable water from the concrete to drain while hardening or thereafter.

Figure 10:
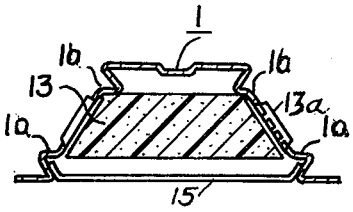
FIG. 10 shows a further modification for supporting insulation batts.

FIG. 10, when inverted, would show an acoustic cellular assembly for a built-up roof (not shown) having insulating batts 13 which are held in close proximity to perforated webs 13*a* forming the side walls of the undulating structure and supported by dovetail element 16. The flush type cap 15 provides a flat surface to accommodate the built-up roof.

Figure 11:
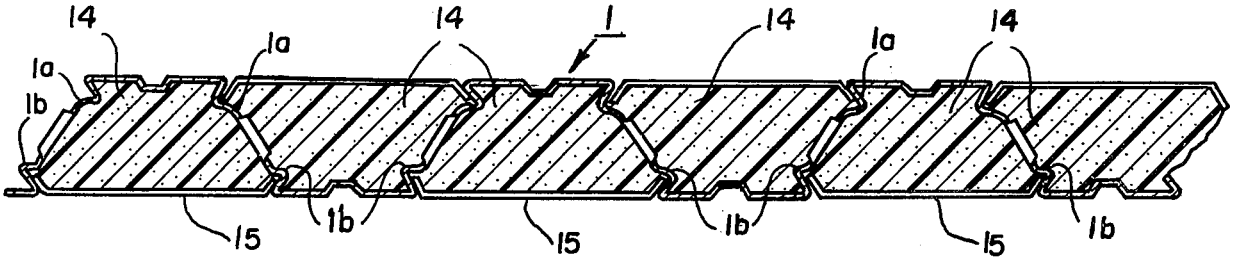
FIG. 11 shows a still further modification involving an insulated panel.

FIG. 11 shows an insulated panel wherein foam or fiber insulation 14 is provided inside each of the closed cells, which cells are closed at both the top and bottom walls by detachable caps 15 whose ends are flared so as to snugly and resiliently fit into the dove-tailed sections 1*b* and/or 1*c*.

Figure 12:
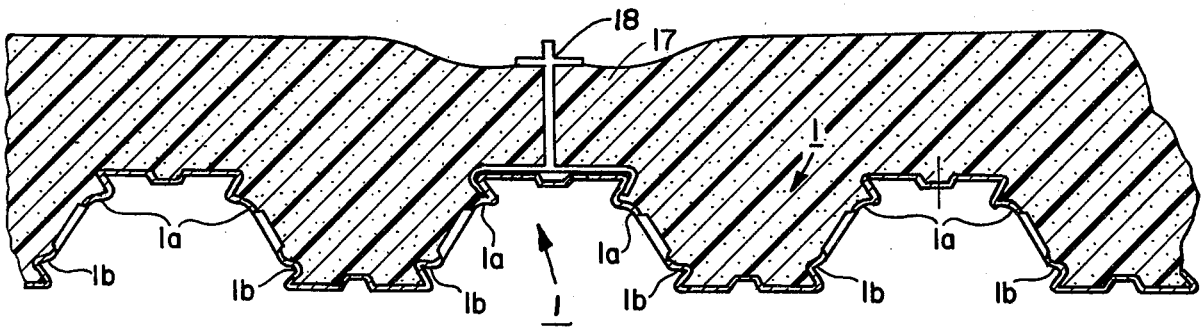
FIG. 12 shows a modified deck having an insulating covering.

FIG. 12, when inverted, would show an exposed metal roofing or siding having a layer of draped insulation 17 held by an insulation clip 18 extending from a bottom portion of the deck. The closure caps, such as 2 (FIG. 3), may be of arcuate cross section as shown for aesthetic purposes.

Cellular sections may be blended with sections to form modules. A typical module comprises three cells of raceway and the balance fluted to form a 5 foot module. The module can be satisfied by furnishing 36" coverage cellular and 24" coverage fluted. If the deck fabricator does not have the 36" coverage capacity, then various versions of one and two cell 24" coverage cellular and 24" coverage fluted sections have to be supplied. In the proposed construction, one cellular section and one fluted section would satisfy the module requirement. Less pieces and varieties and/or steel would be required. The basic steel savings would be about 83% of the 12" pitch requirement based on conventional cover plate construction and approximately 65% to 70% of the 12" pitch requirement based on the use of detachable closures of the present invention.

Thus it will be seen that I have provided a highly efficient structure particularly suitable for roof and floor decks providing strong interlocking with the poured concrete slab and which enables great versitility of applications and which requires a minimum of inventory, -also which can be nested and packed into a very compact space resulting in very substantial savings in shipping costs.

While I have illustrated and described several embodiments of my invention, it will be understood that these are by way of illustration only and that various changes and modifications may be contemplated in my invention and within the scope of the following claims.

I claim:

1. A structural deck for supporting concrete floors in interlocking relationship, comprising an undulating symmetrical and reversible structure having substantially horizontal bottom walls and top walls having inwardly extending central ribbed portions of identical construction, said bottom and top walls being of identical but inverted construction interconnected by downwardly and outwardly tapered, substantially flat sidewalls, the top portions of said sidewalls having immediately adjacent inwardly extending dove-tailed flanges projecting directly below the side portions of said top walls to serve as interlocking elements and supports for articles that may be suspended inside the deck, the bottom portions of said sidewalls having immediately adjacent inwardly extending dove-tailed flanges projecting directly above the side portions of said bottom wall so as to make the deck of inverted symmetrical construction throughout, and readily detachable closure means suspended by said last-mentioned flanges for forming closed cells with at least some of the undulations of said structure.

2. A deck as recited in claim 1 wherein said sidewalls are disposed at an angle of about 58° with respect to the plane of said bottom walls and wherein said closure means forms closed cells with all the undulations of said structure.

3. A deck as recited in claim 2 together with readily detachable closure means mounted on said first-mentioned flanges to form closed cells with all the undulations of said structure.

4. A deck as recited in claim 1 wherein said closure means have end portions which are reversely bent.

5. A deck as recited in claim 1 wherein said closure means have exposed concave surfaces.

6. A deck as recited in claim 1 wherein said closure means have flat surfaces.

7. A deck as recited in claim 1 together with a layer of cementitious material supported by said deck and interlocked therewith by said inwardly extending dove-tailed flanges.

8. A deck as recited in claim 2 together with accessory means in said enclosed cell having supporting means snugly fitting the interior surfaces of said inwardly extending dove-tailed flanges in said top portions of said sidewalls.

9. A deck as recited in claim 1 wherein said accessory means comprises a batt of fibrous heat insulation and wherein said supporting means comprises spring clips.

10. A deck as recited in claim 8 wherein said accessory means comprises tubular lighting fixtures.

11. A deck as recited in claim 1 together with a layer of fibrous heat insulation supported on said structural deck and insulation clips for fastening said insulation to said structural deck.

* * * * *